United States Patent [19]

Carson, Jr. et al.

[11] 4,288,167

[45] Sep. 8, 1981

[54] PRINTHEAD AND BLADES THEREFOR

[75] Inventors: Andrew B. Carson, Jr., Waynesboro; Frederick M. Blodgett, Jr., Stuarts Draft, both of Va.

[73] Assignee: General Electric Company, Waynesboro, Va.

[21] Appl. No.: 121,132

[22] Filed: Feb. 13, 1980

[51] Int. Cl.[3] ..... B41J 3/12

[52] U.S. Cl. ..... 400/121; 101/93.04

[58] Field of Search ..... 400/121, 124; 101/93.04, 93.05

[56] References Cited

U.S. PATENT DOCUMENTS

| | | | |
|---|---|---|---|
| 3,282,203 | 11/1966 | Kalbach et al. | 101/93.34 |
| 3,735,698 | 5/1973 | Lenders et al. | 101/93.34 |
| 3,971,311 | 7/1976 | Deproux | 101/93.04 |
| 4,129,390 | 12/1978 | Bigelow et al. | 400/121 |

*Primary Examiner*—Paul T. Sewell

*Attorney, Agent, or Firm*—Michael Masnik

[57] ABSTRACT

A printhead for a dot matrix impact printer comprises a stack of thin printing blades each including a flat spiral coil mounted in a rim which is in turn connected by flexible mounting arms to a mounting portion. Each blade has an arcuate printing arm extending from one side of the rim thereof and carrying a stylus, with the printing arms of adjacent blades being curved in opposite directions with the concave sides thereof facing each other so as to provide therebetween a large separation area to prevent wicking of ink from the styli to the coils of the blades. Each print arm carries a stabilizing member extending from the concave side thereof, with the stabilizing members of adjacent blades overlapping for cooperation to divide the separation area between said blades into inner and outer regions, the outer region serving to block particulate debris and isolate it from the inner regions thereby to prevent interference with the anti-wicking function of the inner regions. Assembly and operation of the printhead is facilitated by the use of separators between individual blades, the method of mounting the coils and the use of connecting tabs on the mounting portion of the blade adapted for insertion into the complementary sockets of an associated circuit board.

20 Claims, 7 Drawing Figures

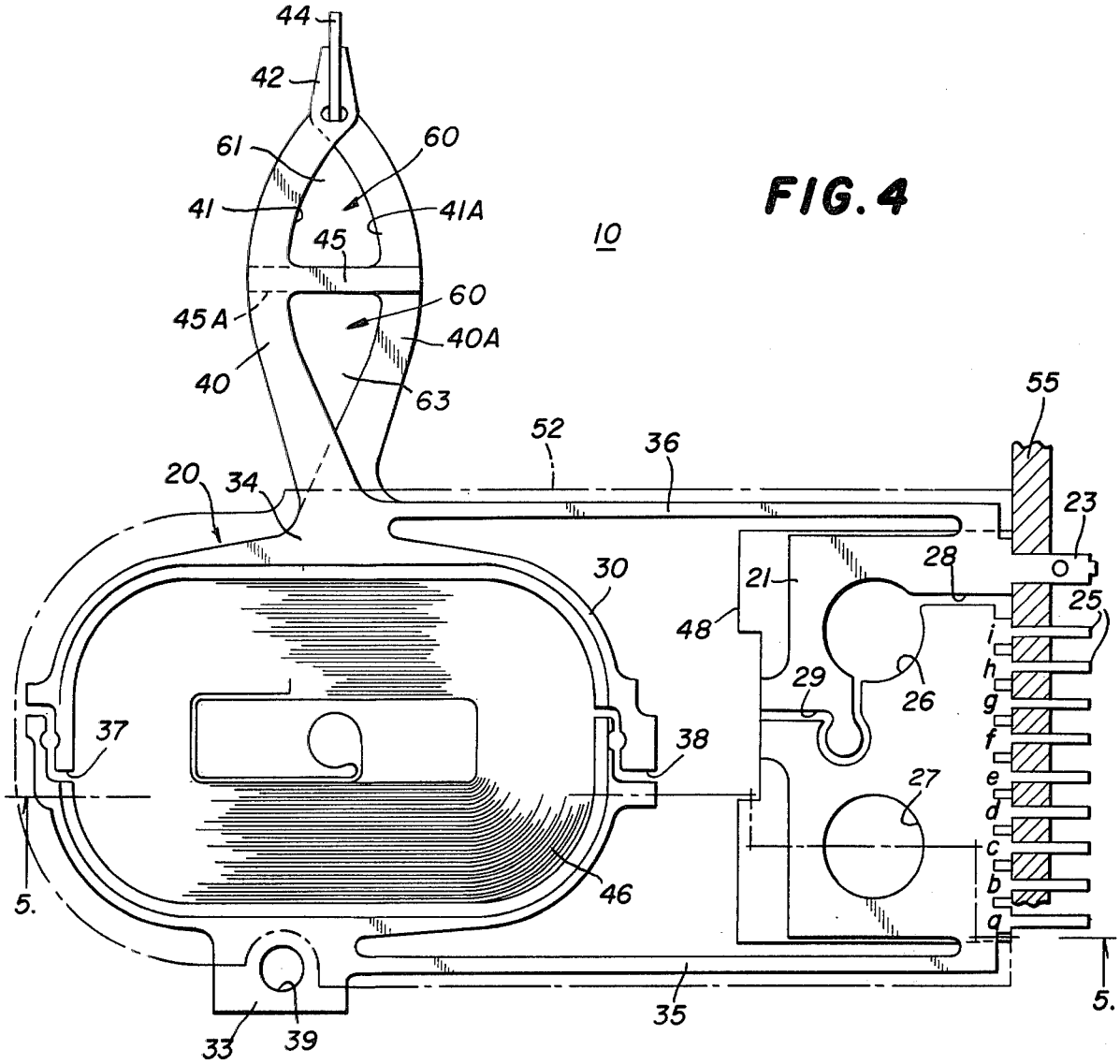
FIG. 4
FIG. 5
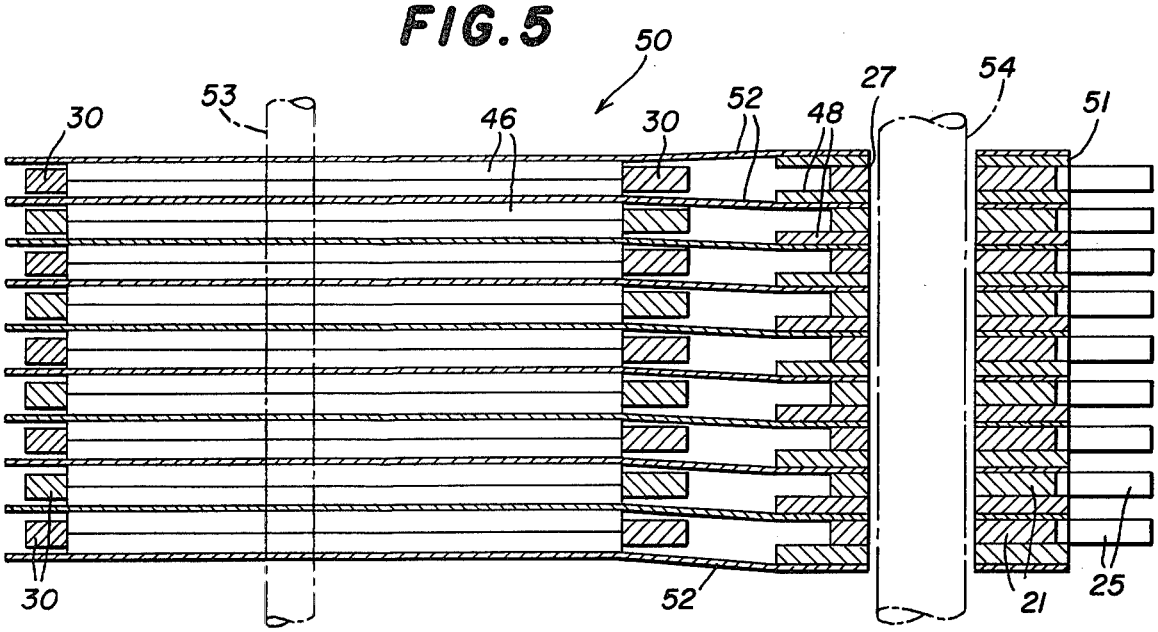

PRINTHEAD AND BLADES THEREFOR

BACKGROUND OF THE INVENTION

The present invention relates to printheads for matrix impact printers employing printing blades as the printing mechanism.

The use of flat, planar printing blades arranged in a stack to form a printhead in a dot matrix impact printer is well known in the art, such a construction being illustrated in U.S. Pat. No. 4,129,390. The printing blade typically comprises a rim portion carrying a flat coil therein and connected by a pair of flexible mounting arms to a mounting portion. Projecting from one side of the coil rim is an elongated printing arm carrying a printing stylus at the distal end thereof. In operation, the stack of printing blades is disposed in a magnetic field extending substantially normal to the planes of the coils. When a current is selectively applied to one of the coils in a predetermined direction, the rim and the printing arm thereof move in a printing direction for impacting a record medium, such as paper, through an inked ribbon to perform the printing function in a well-known manner, this movement being accommodated by the flexible mounting arms.

It is known in such prior art printheads to provide small apertures in the tips of the printing arms to serve as a barrier to prevent wicking of ink between adjacent printing arms into the coil regions of the printing blades. In one such arrangement, disclosed in the aforementioned U.S. Pat. No. 4,129,390, the printing tips of adjacent printing blades in the stack have oppositely-curved portions which define a small aperture or separation area therebetween to perform the anti-wicking function.

However, it has been found under certain circumstances that these very small apertures in the printing tips of the printing blades are insufficient effectively to prevent undesirable wicking of ink along the printing arms. Furthermore, it has been found that where fabric ink ribbons are used, tiny particles of the ribbon fabric and other debris from the imprinted paper and the like tend to accumulate in the small apertures in the tips of the printing arms and clog them with a material which has a character of a saturated felt and serves to fill the separation and defeat any anti-wicking function it may have otherwise been capable of performing.

SUMMARY OF THE INVENTION

It is a general object of the present invention to provide an improved printing blade for use in a printhead of a matrix impact printer which avoids the difficulties of prior art printing blades and which affords additional structural and operational advantages.

More specifically, it is an important object of the present invention to provide a printing blade of the character described which is designed for cooperation with adjacent printing blades effectively to prevent wicking of ink from the ink ribbon along the printing arms to the coil of the printing blade.

It is another object of this invention to provide a printing blade of the character described, which provides effective impact control of the printing stylus.

Yet another object of this invention is the provision of a printing blade of the character described, which is arranged for cooperation with like printing blades to facilitate the alignment thereof in a printhead.

It is another object of this invention to provide a lower cost, more reliable printhead and method of assembly thereof employing a plurality of the printing blades.

In accordance with one embodiment of the invention a flat printing blade is provided of the type having a flat generally annular rim in which is retained a flat spiral, substantially planar coil energizable for interaction with an associated magnetic field to effect movement in a predetermined direction parallel to the plane of the coil. A mounting portion is provided spaced from the rim and substantially parallel to the plane of the coil. A pair of resilient mounting arms extend from the mounting portion to opposed points on the rim. An elongated arcuate printing arm extends from the rim at a predetermined location generally in the predetermined direction and terminates in a printing tip, an elongated stabilizing member extends from the concave side of the printing arm intermediate the ends thereof substantially parallel to the plane of the coil to serve a plurality of functions.

Further features of the invention pertain to the particular arrangement of the parts of the printhead and the printing blades thereof whereby the above-outlined and additional operating features thereof are attained.

The invention, both as to its organization and method of operation, together with further objects and advantages thereof, will best be understood by reference to the following specifications taken in connection with the accompanying drawings.

BRIEF DESCRIPTION OF THE DRAWINGS

FIG. 4 is a top plan view of a printhead comprising a stack of the printing blades of FIGS. 1 and 2 arranged in alternating relationship, and illustrating the attachment of the printhead to an associated circuit board;

FIG. 5 is an enlarged view in vertical section taken along the line 5—5 in FIG. 4;

DESCRIPTION OF THE PREFERRED EMBODIMENT

Figure 1:
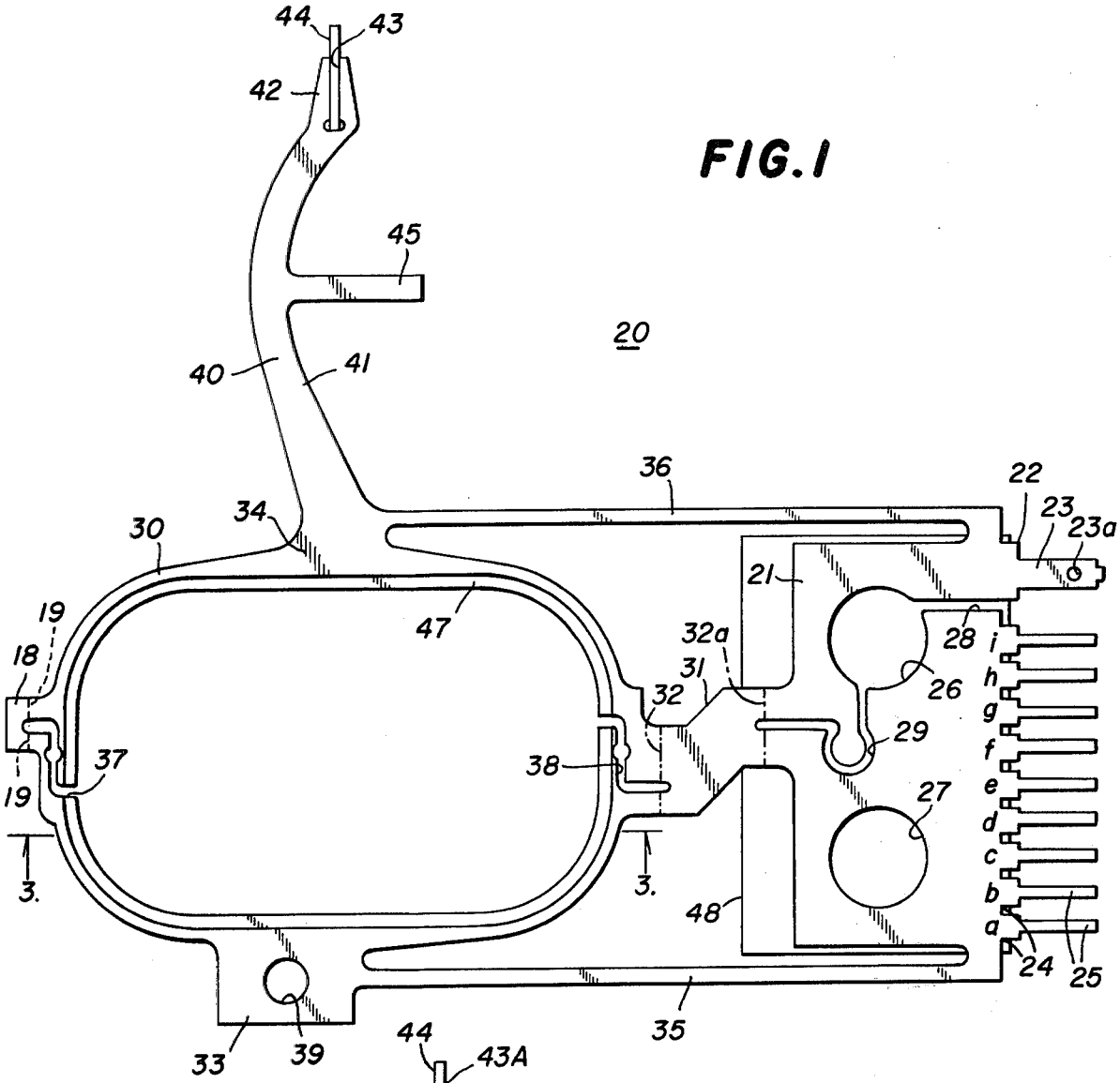
FIG. 1 is a top plan view of a printing blade constructed in accordance with and embodying the features of the present invention.
Figure 2:
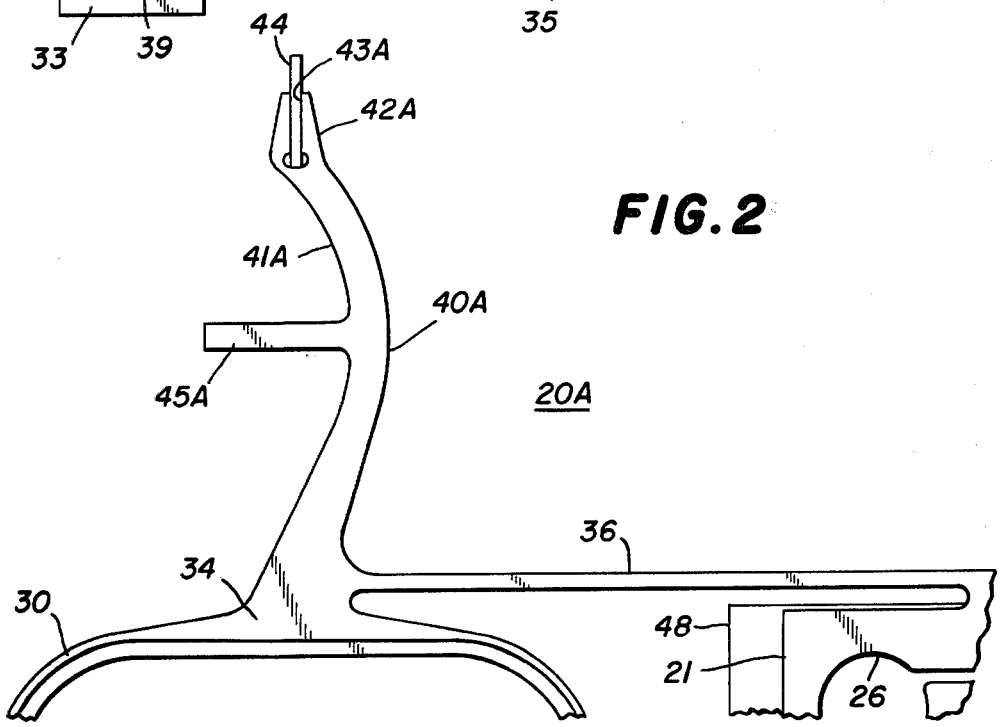
FIG. 2 is a fragmentary view, similar to FIG. 1, illustrating another printing blade of the present invention, identical to that of FIG. 1, with the exception that the printing arm is curved in the opposite direction.
Figure 6:
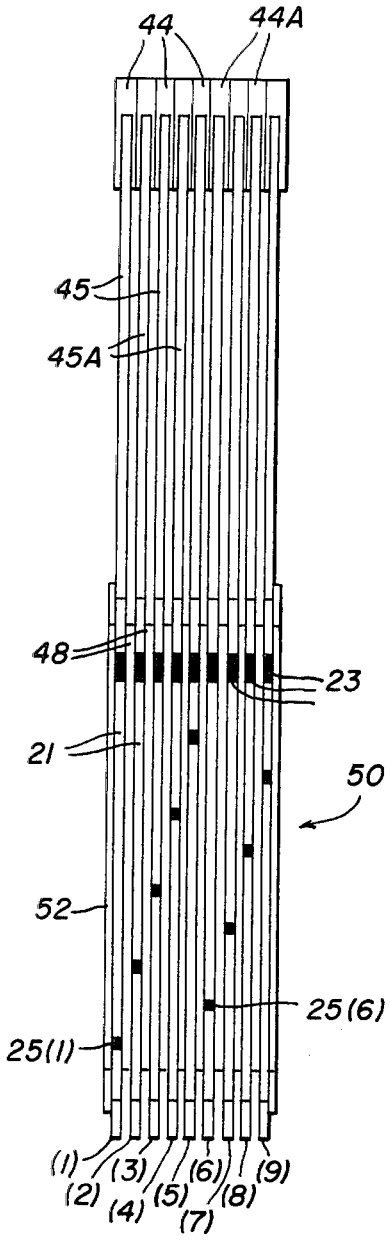
FIG. 6 is an end elevational view of the printhead of FIG. 4, as viewed from the right-hand end thereof and with the associated printed circuit board removed.

FIG. 4 illustrates a printhead, generally designated by the numeral 10, comprising a plurality of printing blades, generally designated by the numerals 20 and 20A, the printing blade 20 being illustrated in FIG. 1 and the printing blade 20A being illustrated in FIG. 2. The printhead 10 is of the type used in an impact printer of the dot matrix type, examples of such printheads being disclosed in U.S. Pat. No. 4,129,390, and in the copending application Ser. No. 051,727, filed June 25, 1979 and entitled "Split Stackable Printing Blades for Matrix Printer Head", assigned to the assignee of the present invention.

Referring to FIG. 1, the printing blade 20 is of thin, flat, substantially planar construction and includes a generally rectangular mounting portion 21 and provided along one edge thereof with a relatively large tab shoulder 22 having a relatively wide elongated tab 23 projecting therefrom, the tab 23 having an aperture 23*a* extending therethrough to facilitate connection to an associated conductor or the like. Also projecting from the same edge of the mounting portion 21 is a plurality of small tab shoulders 24, preferably nine in number for a nine blade assembly, and each having extending therefrom a relatively narrow elongated tab 25. The tabs 23 and 25 are all disposed in alignment with each other and substantially coplanar with the mounting portion 21, the narrow tabs 25 preferably being equidistantly spaced apart. Formed in the mounting portion 21 are two spaced-apart large circular apertures 26 and 27. The aperture 26 communicates via a narrow channel 28 with the outer edge of the mounting portion 21 between the tab 23 and the adjacent one of the tabs 25. The aperture 26 also communicates with one end of a narrow elongated channel 29.

The printing blade 20 also includes a substantially oval rim 30 connected at one end thereof by a neck 31 to the inner edge of the mounting portion 21 intermediate the ends thereof. In use, the neck 31 is removed by severing it from the rim 30 and the mounting portion 21 along separation lines 32 and 32*a*, as will be explained more fully below. Integral with the rim 30 and respectively projecting from opposite sides thereof are a flat, generally rectangular projection 33 and an enlarged irregular flat projection 34, the projections 33 and 34 being respectively connected by elongated, parallel, flexible mounting arms 35 and 36 to the opposite ends of the mounting portion 21 and being substantially coplanar therewith. A narrow channel 37 is formed through the rim 30 to the neck 18. The neck 18 is removed by severing it from the rim along the separation line 19 such that channel 37 provides communication between the inner and outer edges of the rim at the end thereof opposite the neck 31, while a narrow channel 38 extends through the rim 30 and projects into the neck 31. Formed in the rectangular projection 33 is a circular alignment aperture 39, for a purpose to be explained below. The distal end of the channel 29 also projects into the neck 31, the separation lines 32 and 32*a* respectively crossing the inner ends of the channels 38 and 29 so that, when the necks 31 and 18 are removed, the channels 28, 29, 37 and 38 will cooperate to separate the printing blade 20 into two spaced-apart sections.

Integral and substantially coplanar with the projection 34 and extending therefrom in a printing direction generally perpendicular to the longitudinal axes of the mounting arms 35 and 36 is an elongated curved printing arm 40, having a generally concave inner edge 41, and terminating in a printing tip 42 having a narrow elongated slot 43 formed therein and projecting in the printing direction. Fixedly mounted in the slot 43 and projecting a predetermined distance therefrom in the printing direction is a stylus 44. The axis of the stylus 44 is arranged to pass (shown in dotted line) substantially through the center of gravity of the blade. Integral with the printing arm 40 and projecting from the concave inner edge 41 thereof intermediate the ends thereof and substantially coplanar therewith in a direction substantially parallel to the mounting arms 35 and 36 is an elongated stabilizing member 45.

Figure 3:
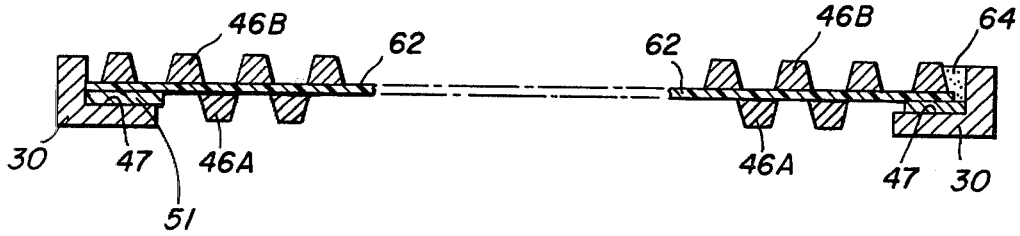
FIG. 3 is an enlarged view in vertical section taken along the line 3—3 in FIG. 1.

Mounted in the rim 30 (see FIG. 3) are a pair of flat spiral coils 46A and 46B separated by and supported by a thin insulating substrate 62. The rim 30, typically of beryllium copper, is provided with a recessed portion 47 along the entire perimeter thereof to form a seat to facilitate the mounting of the coil 46 thereon (shown in exaggerated form in FIG. 3). In one embodiment a copper clad insulating substrate is used to form the coil. The substrate 62 has windings 46 etched on both sides with the bottom windings 46A making electrical contact with the recessed portion 47 of rim 30 through the etched conductor portion 51 and the top windings 46B making electrical contact with the recessed portion 47 by soldering to the rim 30 as shown at 64. The connection between the top and bottom windings is made near the center of the coils, as for example, by a plated or soldered through connection, etc. as shown at 65 in FIG. 4. The thickness of the coil 46 is somewhat greater than that of the mounting portion 21 and, therefore, there is secured to one side of the mounting portion 21, as by adhesive, a spacer 48 formed of an electrically insulating material to hold the two sections of the blade support 21 together after removal of the neck 31, and to provide the appropriate spacing between adjacent printing blades.

Referring to FIG. 2 of the drawings, the printing blade 20A is identical to the printing blade 20, with the exception of the printing arm. Accordingly, the like portions of the printing blades 20 and 20A bear identical reference numbers, with the differing portions of the printing blade 20A having the suffix A added thereto. Integral with the projection 34 and extending therefrom generally in the printing direction is an elongated arcuate printing arm 40A having a generally concave inner edge 41A, the printing arm 40A being curved in the opposite direction from the printing arm 40. The printing arm 40A terminates in a printing tip 42A having a slot 43A therein in which is fixedly secured a stylus 44 projecting in the printing direction. Integral with the printing arm 40A intermediate the ends thereof and projecting from the inner edge 41A thereof substantially normal to the printing direction is an elongated stabilizing member 45A. The printing arm 40A and the stabilizing member 45A are substantially coplanar with the mounting portion 21 of the printing blade 20A.

Referring now to FIGS. 4 through 7 of the drawings, the printhead 10 is formed by arranging a plurality of the printing blades 20 and 20A in a stack 50 so that the printing blades 20 alternate with the printing blades 20A, as best seen in FIG. 5. In one embodiment, the printhead 10 included a stack of five each of the printing blades 20 and four each of the blades 20A for a 9 dot vertical matrix. It can be seen from FIG. 5 that the spacers 48 serve to provide a separation between blades and the housing and between the printing blades 20 and 20A so that the coils 46 thereof will have a very slight clearance therebetween in order to permit movement thereof with respect to one another during the printing operation. In one embodiment there was also provided a plurality of very thin, smooth separators 52 respectively disposed between the printing blades 20 and 20A to prevent rough surfaces of the coils and other blade parts from rubbing directly against one another in use. The separators 52 are preferably formed of an electrically insulating material, such as a polyimide film, to insure electrical insulation of the printing blades 20 and 20A from one another.

During assembly of the printing blades in the stack 50, the necks 31 and 18 are removed. The blades are aligned with respect to one another by use of a locating pin 53 disposed through the alignment apertures 39 of all of the printing blades in the stack and fixing all the blade tips in vertical alignment in a fixture. Then the blades are secured with the insulators 48 in a stack by adhesives so that the stack remains in alignment during subsequent assembly operations. With the stack 50 of printing blades properly aligned and the necks 31 and 18 removed, the printing blades of the stack 50 are securely fastened together and to the associated housing by suitable fasteners 54, such as screws, which extend through the apertures 26 and 27 in the mounting portions 21, after which the locatng pin 53 may be removed. The apertures 26 may be made oversize to allow for tolerances resulting from the initial alignment and also to provide an alignment of blades 20 and 20A with a slight preload to keep the blades against an associated backstop to be provided behind 33. This insures correct dynamic operation of the blades.

Figure 7:
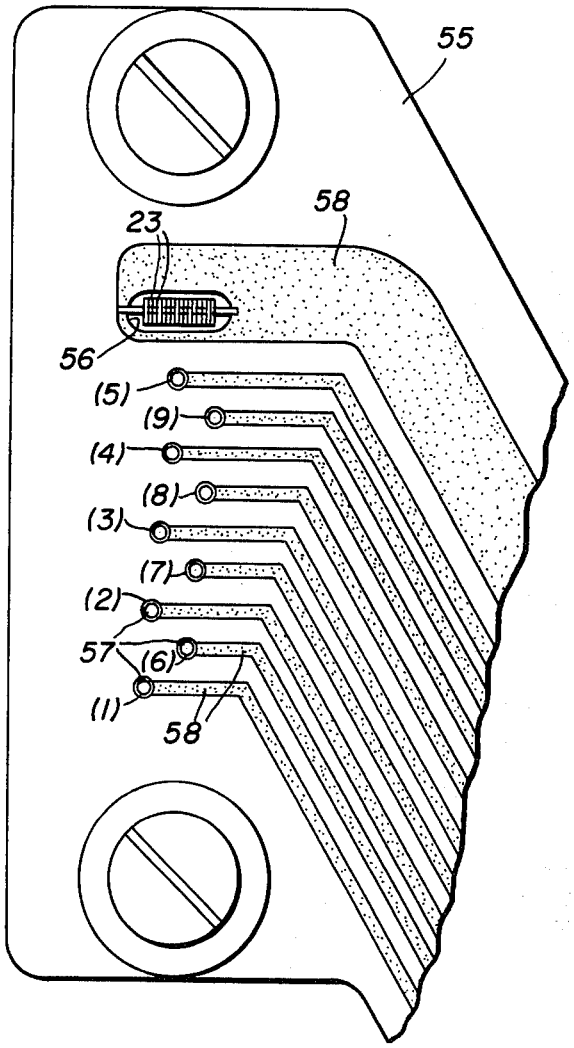
FIG. 7 is an enlarged fragmentary plan view of the circuit board illustrated in FIG. 4, with the printhead coupled thereto.

It is a significant feature of the present invention that the elongated tabs 23 and 25 of the printing blades 20 and 20A permit the printhead 10 to be plugged, as a unit, into female receptacles of an associated printed circuit board 55, or the like. Referring to FIG. 7, the circuit board 55 preferably includes a relatively large elongated oval aperture 56 and a plurality of small sockets 57, arranged substantially in two parallel rows, the rows being slightly inclined with respect to the normal to the longitudinal axis of the elongated aperture 56 for clearance purposes, and with the sockets of one row being disposed in staggered relationship with the sockets of the other row. The sockets 57 and the perimeter of the aperture 56 are respectively connected to printed circuit leads 58 for connection to associated circuitry.

Each of the printng blades in the stack 50 has all but one of the narrow tabs 25 thereof removed by being severed or broken off at the associated shoulder 54, so that the one remaining tab 25 on each printing blade is in a different position from the remaining tab 25 of all of the other printing blades. Thus, referring to FIGS. 4, 6 and 7, if the positions of the narrow tabs 25 on each printing blade are respectively designated "a" through "i", as indicated in FIG. 4, and if the blades in the stack 50 are respectively designated (1) through (9), then the remaining tabs 25 of the blades (1) through (5) are respectively in the positions a, c, e, g and i, while the remaining tabs 25 of the blades (6) through (9) are respectively in the positions (b), (d), (f) and (h). The wide tabs 23 of printing blades of the stack 50 will be disposed in alignment in the direction of the thickness of the stack.

Thus, it will be appreciated that the small tabs 25 will be arranged in two parallel rows in staggered relationship for respective mating engagement in the sockets 57, while the aligned wide tabs 23 will all be receivable in the elongated aperture 56 in the printed circuit board 55. Preferably, the small tabs 25 are disposed in frictional electrical contact in the sockets 57, and the wide tabs 23 are all connected together in common and to the associated printed circuit lead 58 as by soldering or the like. Thus, it will be appreciated that the printhead 10 may be plugged as a unit into the associated circuit board 55 for ease of assembly with associated circuitry of the dot matrix printer.

It can be seen that when the printing blades 20 and 20A are arranged in the stack 50, they are substantially congruent with the exception of the printing arms 40 and 40A, which are oppositely curved so that adjacent printing arms 40 and 40A cooperate to define therebetween a large generally oval aperture or separation area 60. It will also be seen that the stabilizing members 45 and 45A of adjacent printing blades are disposed in overlapping relationship completely to span the aperture 60 and separate it into an outer portion 61 and an inner portion 63.

It will be understood that the stack 50 of printing blades in the printhead 10 is arranged in use in a magnetic field directed substantially normal to the planes of the printing blades. That is, a magnetic field passes in one direction through one side of the loop and in the opposite direction on the other side of the loop in a well known manner. The opposite ends of the coil 46 are respectively electrically connected to the two separated sections of the printing blade 20 (or 20A), and an associated source of electrical current is connected across the terminals provided by the wide tab 23 and the one remaining narrow tab 25, with the wide tabs 23 being connected to common. The use of a common terminal permits operation of all arcuate arm portions of the blades at a common potential without undesirable electrical effects when the tips make contact with one another. Thus, when current is selectively applied across the terminals of one of the printing blades, the current flows through the coil 46 in a direction for cooperation with the associated magnetic field to move the coil 46 and the associated printing arm 40 (or 40A) in the printing direction for impacting the stylus 44 against the associated print ribbon in a well-known manner, this movement being accommodated by the resilient, flexible mounting arms 35 and 36.

In operation, the large aperture portions 61 and 63 serve effectively to prevent wicking of ink along the printing arms 40 and 40A from the styli 44 to the region of the coils 46. One of the reasons prior art apertures did not effectively serve this purpose was that they easily became clogged with small bits or print ribbon and paper and associated debris resulting from the printing operation. This debris would form a felt-like mat blocking the aperture and effectively bridging it. In the present invention this difficulty is avoided, first of all because the substantially larger aperture 60 is much more difficult to clog and can accommodate a much larger volume of material. Furthermore, any such small particulate debris which does accumulate will collect in the outer portion 61 of the aperture, and, even if that relatively large portion should become clogged, the homogeneity of the matted debris is such that the stabilizing members 45 will serve to isolate the collected debris from the inner portion 63 of the aperture, which inner portion will remain to serve as an anti-wicking barrier to prevent migration of ink and debris farther into the moving parts of the blade.

Because of the substantial curvature of the printing arms 40 and 40A, the stabilizing members 45 and 45A serve to provide structural strengthening of the printing arms and also serve to damp undesirable vibrations and deflections of the styli 44, thereby to stabilize their motion during the printing operation. The deep curvature of the printing arms 40 and 40A, in addition to providing the anti-wicking aperture 60 described above, also effectively serves as a spring between the stylus 44 and the primary moving mass of the printing blade which is provided by the coil 46, this spring function serving to provide impact control for the stylus 44 to achieve controlled printing pressure.

In a constructional model of the present invention the printing blade 20 (or 20A) is formed of beryllium copper, the spacers 48 and 51 are formed of thin sheets of insulating material such as an aramid fiber sold by Du Pont Company under the trademark "NOMEX"; each of the separators 52 comprises a polyimide film, such as that sold by Du Pont Company under the trademark "KAPTON"; and the styli 44 may be brazed or soldered or otherwise attached in place on the printing tips 42 (or 42A). The separator 52 covers substantially the entire printing blade 20 (or 20A) except for the tabs 23 and 25 and the printing arm 40 (or 40A). Apertures are provided in the separators 52 in alignment with the fastener apertures 26 and 27 and locating pin apertures 39 in the printing blades.

From the foregoing it can be seen that there has been provided an improved printhead and improved printing blades therefor, uniquely designed effectively to prevent wicking of ink from the printing styli to the driving coils, to facilitate connection of the printhead to associated circuitry, to facilitate alignment of the printing blades in the printhead, to stabilize the motion of the printing stylus during the printing operation, and to control the nature of the impact of the printing stylus during the printing operation.

What we claim as new and desire to secure by Letters Patent of the United States is:

1. In a flat printing blade of the type having a flat generally annular rim in which is retained a flat-spiral substantially planar coil energizable for interaction with an associated magnetic field to effect movement of the rim in a predetermined direction parallel to the plane of the coil, a mounting portion spaced from the rim and substantially parallel to the plane of the coil, and a pair of resilient mounting arms spaced apart in the predetermined direction and extending from the mounting portion to opposed points on the rim, the improvement comprising:

an elongated arcuate printing arm extending from the rib generally in the predetermined direction and terminating in a printing tip, and an elongated stabilizing member extending from the concave side of said printing arm intermediate the ends thereof substantially parallel to the plane of the coil.

2. The printing blade of claim 1, wherein said stabilizing member extends substantially normal to said predetermined direction.

3. The printing blade of claim 1, wherein said printing arm is substantially coplanar with the coil and with said stabilizing member.

4. The printing blade of claim 1, and further including a printing stylus carried by said printing tip and projecting therefrom in the predetermined direction.

5. The printing blade of claim 1, and further including a plurality of connection members extending from the mounting portion and adapted to be plugged into associated sockets.

6. A printhead comprising a plurality of the printing blades of claim 1, said printing blades being arranged in a stack with the planes of said coils parallel and with said printing tips of said blades being aligned in a direction substantially normal to said planes, insulating means for insulating said blades from one another in areas having a difference in electrical potential, and means for retaining said blades in said stack, said printing arms of adjacent ones of said blades being oppositely curved and arranged with the concave sides thereof facing each other to provide a wide separation area therebetween in directions parallel to said planes, said stabilizing members of adjacent ones of said printing arms overlapping and being aligned in a direction substantially normal to said planes for cooperation to divide the separation areas between said arms into outer regions adjacent to said printing tips and inner regions adjacent to said rims, said separation areas being sufficiently large to prevent wicking of ink along adjacent printing arms from the printing tips thereof to said rims, the outer regions of said separation areas serving to collect particulate debris and isolate it from the inner regions thereby to prevent interference with the anti-wicking function of the inner regions.

7. The printhead of claim 6, wherein said inner and outer regions have approximately the same area.

8. The printhead of claim 6, wherein each of said stabilizing members spans the separation area between adjacent ones of said printing arms.

9. The printhead of claim 6, wherein said printing blades are respectively provided with apertures therein disposed in alignment in a direction normal to said plane to facilitate alignment of said blades in said stack.

10. The printhead of claim 6, wherein each of said printing blades further includes a plurality of connection members extending from the mounting portion thereof and adapted to be plugged into associated sockets.

11. The printhead of claim 10, wherein the positions of at least certain of the connection members on said blades are sequentially staggered from one end of said stack to the other.

12. The printhead of claim 6, and further including smooth separating means interposed between adjacent ones of said printing blades for preventing contact thereof with each other.

13. A printhead comprising a plurality of the printing blades, each of said printing blades comprising a flat generally annular rim, a flat-spiral substantially planar coil retained in said rim and energizable for interaction with a magnetic field to effect movement of the rim in a predetermined direction parallel to the plane of the coil, a mounting portion spaced from the rim and substantially parallel to the plane of the coil, and a pair of resilient mounting arms spaced apart in the predetermined direction and extending from the mounting portion to opposed points on the rim, an elongated arcuate printing arm extending from the rim generally in the predetermined direction and terminating in a printing tip, an elongated stabilizing member extending from the concave side of said printing arm intermediate the ends thereof substantially parallel to the plane of the coil means for arranging said printing blades in a stack with the planes of said coils parallel and with said printing tips of said blades being aligned in a direction substantially normal to said planes, insulating means for insulating said blades from one another in areas having a difference in electrical potential, means for retaining said blades in said stack, said printing arms of adjacent ones of said blades being oppositely curved and arranged with the concave sides thereof facing each other to provide a wide separation area therebetween in directions parallel to said planes, said stabilizing members of adjacent ones of said printing arms overlapping and being aligned in a direction substantially normal to said planes for cooperation to divide the separation areas between said arms into outer regions adjacent to said printing tips and inner regions adjacent to said rims, said separation areas being sufficiently large to prevent wicking of ink along adjacent printing arms from the printing tips thereof to said rims, the outer regions of said separation areas serving to collect particulate debris and isolate it from the inner regions thereby to prevent interference with the anti-wicking function of the inner regions.

14. The printhead of claim 13 wherein said inner and outer-regions have approximately the same area.

15. The printhead of claim 14 wherein each of said stabilizing members spans the separation area between adjacent ones of said printing arms.

16. The printhead of claim 13 wherein said printing blades are respectively provided with apertures therein disposed in alignment in a direction normal to said plane to facilitate alignment of said blades in said stack.

17. The printhead of claim 13 wherein each of said printing blades further includes a plurality of connection members extending from the mounting portion thereof and adapted to be plugged into associated sockets.

18. The printhead of claim 17 wherein the positions of at least certain of the connection members on said blades are sequentially staggered from one end of said stack to the other.

19. The printhead of claim 13 wherein smooth separating means are interposed between adjacent ones of said printing blades for preventing contact thereof with each other.

20. A flat printing blade comprising a flat annular frame of electrically conductive material, said frame comprising a rim portion, said rim portion comprising a forward section and a rear section, a flat, spiral, substantially planar coil retained in said rim portion, said coil being double sided with a thin electrically insulating substrate separating the sides thereof, each side of said coil comprising a series of turns, one end of the turns of each side of said coil being electrically connected to a respective one of said front end rear sections, the other end of the turns of each side of said coil being connected together, means for electrically isolating said rear and forward sections from one another, said frame comprising a mounting portion spaced from the rim portion and substantially parallel to the plane of said coil, said mounting portion comprising a forward section and a rear section, said frame comprising a pair of resilient arms spaced apart in the predetermined direction with each arm extending from a respective mounting portion section to opposed points on the rim, means for energizing said coil for interaction with a magnetic field to effect movement of the rim portion in a predetermined direction parallel to the plane of the coil comprising, means for energizing said coil through a respective one of said sections of said mounting portion of said frame, an associated one of said arms and a respective one of said sections of said rim portions of said frame, and through a respective other one of said sections of said mounting portion of said frame, an associated other one of said arms and the other of said sections of said rim portion, an elongated arcuate printing arm extending from the rim generally in the predetermined direction and terminating in a printing tip, and an elongated stabilizing member extending from the concave side of said printing arm intermediate the ends thereof substantially parallel to the plane of the coil.

* * * * *